US007380364B1

(12) United States Patent
Hanson

(10) Patent No.: US 7,380,364 B1
(45) Date of Patent: Jun. 3, 2008

(54) HAND MOUNTABLE CASING COLLECTION APPARATUS

(76) Inventor: Anthony D. Hanson, 1215 N. Main St., Aberdeen, SD (US) 57401

( * ) Notice: Subject to any disclaimer, the term of this patent is extended or adjusted under 35 U.S.C. 154(b) by 11 days.

(21) Appl. No.: 11/581,324

(22) Filed: Oct. 16, 2006

(51) Int. Cl.
*F41A 15/00* (2006.01)

(52) U.S. Cl. ..... 42/98

(58) Field of Classification Search ..... 42/98, 42/94; 2/159, 160
See application file for complete search history.

(56) References Cited

U.S. PATENT DOCUMENTS

| | | | | |
|---|---|---|---|---|
| 3,658,241 | A | 4/1972 | Pistocchi | |
| 4,028,834 | A | 6/1977 | Dobson | |
| 4,296,565 | A * | 10/1981 | Jaffin et al. | 42/98 |
| 4,334,375 | A * | 6/1982 | Olson | 42/98 |
| D297,346 | S * | 8/1988 | MacKenzie et al. | D22/108 |
| 4,959,918 | A * | 10/1990 | Perez | 42/98 |
| 5,003,637 | A * | 4/1991 | Lonon | 2/160 |
| 5,138,787 | A | 8/1992 | Riddle et al. | |
| D382,624 | S | 8/1997 | Benson | |
| 5,664,727 | A | 9/1997 | Beall | |
| 5,666,667 | A * | 9/1997 | Hook, Jr. | 2/159 |
| 5,811,716 | A | 9/1998 | Ellzey | |
| 6,016,620 | A * | 1/2000 | Morgan | 42/94 |
| 6,233,742 | B1 * | 5/2001 | Yungkurth | 2/160 |
| 6,347,475 | B1 * | 2/2002 | Trostel | 42/98 |
| 6,354,035 | B1 | 3/2002 | Niebuhr et al. | |
| 6,393,614 | B1 * | 5/2002 | Eichelbaum | 2/160 |
| 6,401,253 | B2 * | 6/2002 | Brunson | 2/160 |
| 6,530,169 | B1 | 3/2003 | Griffin | |
| 6,766,607 | B2 | 7/2004 | Castaldo | |
| 7,117,541 | B2 * | 10/2006 | Hozack | 2/161.5 |
| 2002/0174477 | A1 * | 11/2002 | Hatch et al. | 2/160 |
| 2003/0089017 | A1 * | 5/2003 | Roush | 42/94 |

* cited by examiner

*Primary Examiner*—Michael J. Carone
*Assistant Examiner*—Daniel J Troy
(74) *Attorney, Agent, or Firm*—Jeffrey A. Proehl; Woods Fuller Shultz & Smith PC

(57) ABSTRACT

A hand-mountable apparatus for collecting spent bullet casings ejected from a firearm. The apparatus comprises a hand-engaging member for engaging a hand of a user, and a spent casing collection apparatus for catching ejected casings and attached to the hand-engaging member.

19 Claims, 4 Drawing Sheets

HAND MOUNTABLE CASING COLLECTION APPARATUS

BACKGROUND OF THE INVENTION

1. Field of the Invention

The present invention relates to firearm accessories, and more particularly relates to a hand mountable apparatus for catching, collecting and storing spent round casings without requiring modification of the firearm or requiring the use of structures that substantially interfere with the firearm's mobility.

2. Description of the Prior Art

Those persons who engage in the sports or activities involving firearms typically seek to garner experience that improves their shooting skills. Such experience is typically obtained by discharging a large number of bullets directed to practice targets.

Semiautomatic firearms are popular because of their ability to automatically prepare themselves for the next shot after each discharge. Though various types of semiautomatic mechanisms are in use, all of these mechanisms eject an exhausted round casing prior to loading a subsequent round. These casings are typically thrown from the side of the firearm to the ground. At the conclusion of shooting practice, the user can chose to leave the casings on the ground or, more desirably, to pick up the casings for proper disposal or refilling.

The problem of collecting spent round casings has been addressed in the prior art. By way of example, U.S. Pat. No. 6,347,475 to Trostel shows a shell catching device that is mountable on the forearm of the user. It appears that this forearm-mounted device limits the lateral movement of the user's wrist, restricting the ability of the shooter to have a free range of motion when aiming.

U.S. Des. Pat. No. 382,624 to Benson; U.S. Pat. No. 4,028,834 to Dobson; U.S. Pat. No. 4,334,375 to Olson; U.S. Pat. No. 5,138,787 to Riddle et al; and U.S. Pat. No. 6,530,169 to Griffin each show various types of casing collection devices for physical attachment to a firearm. These devices require the user to modify each weapon from which he or she intends to collect spent casings. Additionally, these attachments alter the weight distribution and structure of the firearm. Any modification made to the firearm during practice sessions is likely to change the structure and feel of the weapon—the user is essentially practicing technique and improving skill on a modified weapon. When the shell-catching device is later removed so that the weapon can be used in an actual situation, the weapon may handle differently because of the change.

U.S. Pat. No. 6,766,607 to Castaldo; U.S. Pat. No. 6,354,035 to Niebuhr et al; U.S. Pat. No. 4,296,565 to Jaffin et al.; 3,658,241 to Pistocchi; U.S. Pat. No. 5,811,716 to Ellzey; and U.S. Pat. No. 5,664,727 to Beall each show various free-standing devices for catching shells. These devices require placement proximate to the shooter, necessitating extra effort when shooting moving targets, or when practicing with different firearms, each of which may eject the casings different distances, requiring movement of the devices when changing firearms.

While these devices offer various solutions to the broad issue of casing collection, no device exists in the prior art which allows the user to catch casings from multiple weapons without modifying each weapon to include a casing catching assembly, and without employing a cumbersome bracket worn on the arm that prohibits free movement and tends to distract the user, or without assembling a free-standing catching device and taking care to keep the firearm in close enough proximity so that the ejected shells will reach the catching device.

SUMMARY OF THE INVENTION

In view of the foregoing disadvantages inherent in the known types of casing collection devices now present in the prior art, the present invention provides a new hand mounted casing collection device construction wherein the same can be utilized for collecting spent casings exhausted from a firearm.

To attain this, the present invention generally comprises a hand-mountable apparatus for collecting spent casings ejected from a firearm. The apparatus includes a hand-engaging member for engaging a hand of a user, and a spent casing collection apparatus for catching ejected casings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

An advantage of the present invention is the provision of a casing collection function by an apparatus that does not add weight to the firearm body, which may affect aiming of the firearm, as well as providing such function by an apparatus that does not require modification of the firearm, which can restrict use of the apparatus with multiple firearms and may affect holstering and storage of the firearm.

These together with other advantages of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
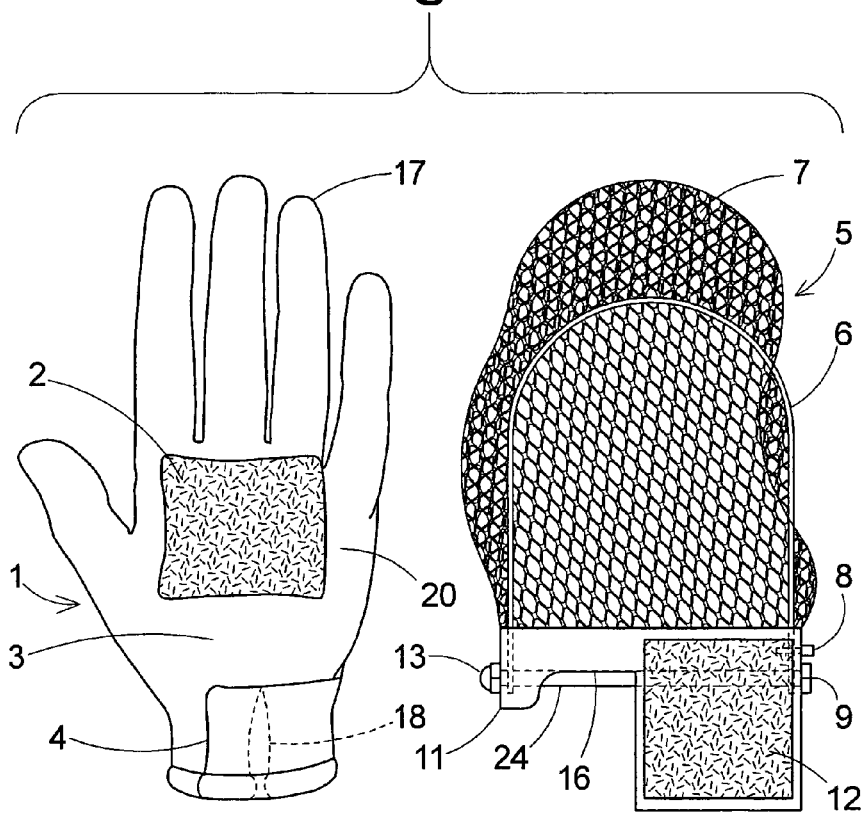
FIG. 1 is a schematic front view of the components of the present invention, showing the glove with an attachment structure.
Figure 2:
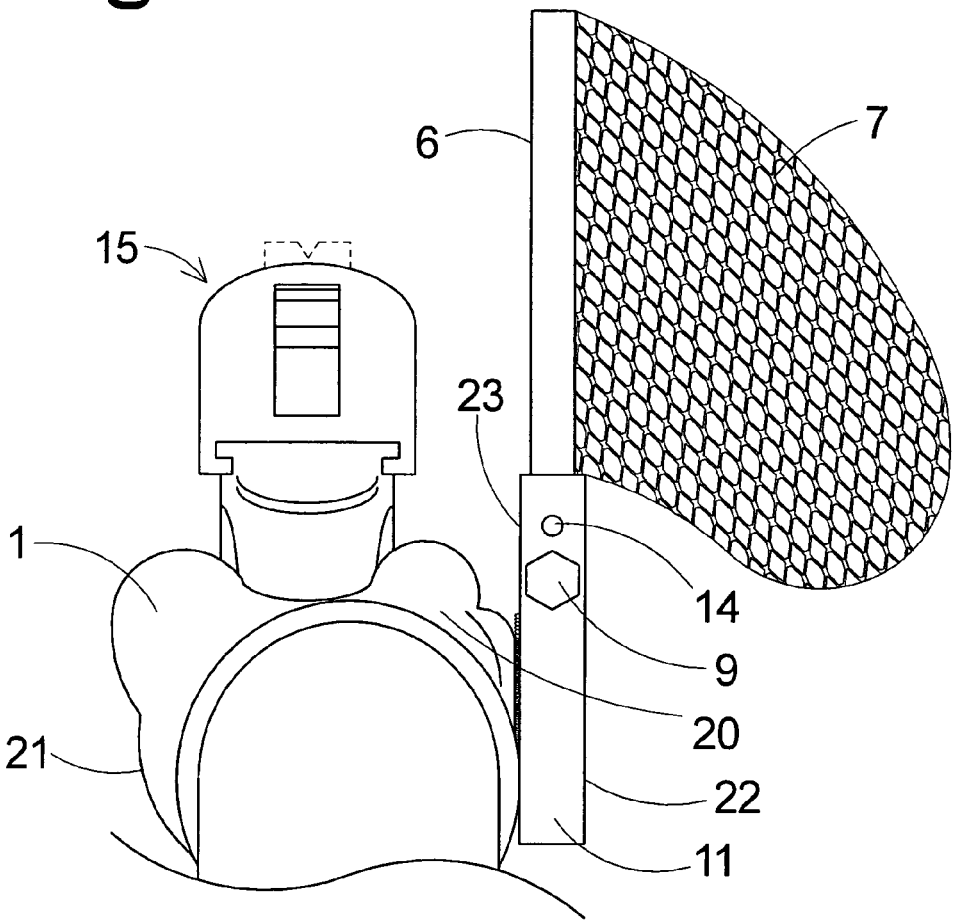
FIG. 2 is a schematic rear elevation view of the apparatus in an in-use position, shown from the perspective seen by the user. The collection apparatus is shown in the upright position, proximate to the firearm to collect spent, ejected casings.
Figure 3:
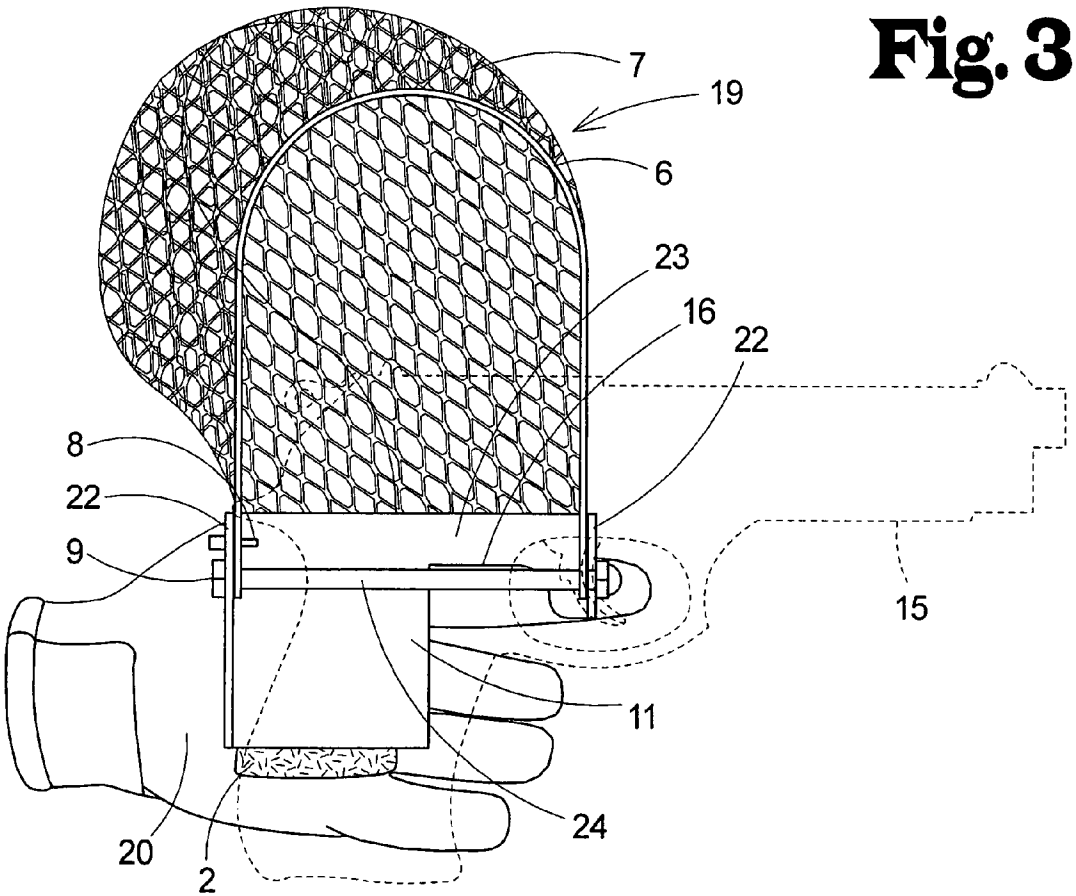
FIG. 3 is a schematic side view of the apparatus in use, showing a gloved hand with the collection apparatus mounted in the upright position to collect spent casings.
Figure 4:
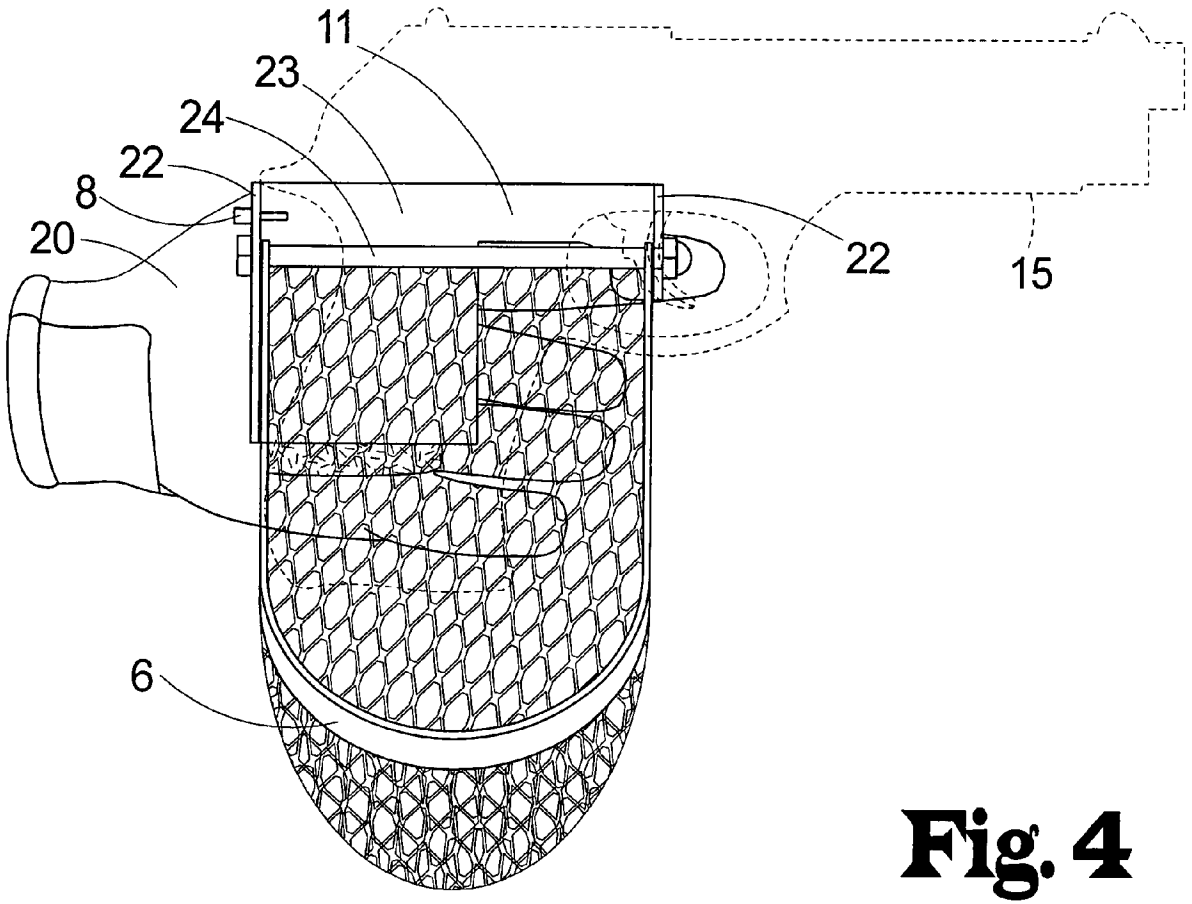
FIG. 4 is a schematic side view facing the right side of the firearm, showing a gloved hand with the collection apparatus mounted in the retracted position.

With reference now to the drawings, and in particular to FIGS. 1 through 4 thereof, a new hand mountable casing collection apparatus embodying the principles and concepts of the present invention and generally designated by the reference numeral 10 will be described.

In FIG. 1, the primary components of the apparatus 10 are shown. The apparatus 10 may have a hand-engaging structure 1, which is shown and described in this description as a glove but is not necessarily limited to a glove, and thus could comprise a different structure. The hand-engaging structure 1 engages the hand of the user, preferably in a removable manner. The structure 1 may include a body portion 3 with a back wall 21 for positioning adjacent to the palm of the user's hand and a front wall 20 for positioning adjacent to the side of the hand opposite the palm. The back wall 21 and front wall 20 may be secured to each other. The hand-engaging structure 1 may also have thumb and finger portions 17 that extend from the body portion 3 to enclose the user's fingers. The front wall 20 of the hand-engaging member may have a slit 18 that runs substantially parallel to the finger portions 17. The slit 18 permits expansion of the body portion 3 so that the user's hand can be inserted and removed. The structure 1 may also include a securing strap 4 with sufficient length to span the slit 18. The securing strap 4 is removably attached to the front wall 20 beyond the slit 18 to securely cinch the hand engaging structure 1 on the user's wrist, holding the structure 1 in place on the hand. The strap 4 is adjustable to accommodate wrists of varying sizes.

The apparatus 10 may further include a casing collection apparatus 5 to catch ejected casings. The casing collection apparatus 5 may include a base member 11 that is mounted on the hand-engaging structure 1, a container support member 6 mounted on the base member 11, and a casing collection container 7 mounted on the container support member 6.

The base member 11 may have a front side and a back side 23, a top end, a bottom end, and side edges. The base member 11 may have a cutout 16 to facilitate free movement of the user's fingers during use. The cutout 16 may be located proximate to one of the side edges of the base member 11. The base member may have two flanges 22, with one flange located adjacent to the cutout on one of the side edges and a second flange located opposite of the cutout on the second side edge. The flanges 22 may extend from the back side 23 of the base member 11 away from the hand-engaging structure 1 when the device is in use. The flanges 22 may each have an aperture to receive a shaft 24 that extends between the flanges 22. The shaft 24 may be secured on one end to the flange by an enlarged head 9, and at the other end of the shaft to the flange with a nut 13.

The container support member 6 may be pivotally mounted on the base member 11 such that the support member 6 is able to pivot with respect to the base member 11. The container support member 6 may be pivotable between two or more positions. The container support member 6 may have opposed ends, with each having an aperture engaged by the shaft 24 to attach the container support member 6 to the base member 11. In some embodiments of the invention, the container support member 6 is substantially U-shaped, and may be formed of a substantially rigid material.

The container support member 6 may further include a locking structure for fixing a position of the support member 6 relative to the base member 11. The locking structure may comprise a first aperture 14 formed in the base member 11 and a second aperture formed in the support member 6. The apertures 14 may receive a securing pin 8 when the openings are adjacent to one another. When the first aperture 14 is positioned adjacent to and is axially aligned with the second aperture, the securing pin 8 may be inserted through the apertures to lock the position of the support member 6 relative to the base member 11, preferably in the in-use position of the support member 6.

The casing collection container 7 may comprise a container with at least one opening for catching the ejected shells. The container may be engaged on the support member 6 in a manner such that the support member 6 maintains the opening of the container in an open condition. In some embodiments of the invention, the collection container comprises a bag 7, which may be formed of a flexible mesh material, but also could be formed of a more rigid material and a material that is continuous in nature without mesh holes. The mouth of the bag 7 forming the opening may define a passage that receives a portion of the length of the support member 6, so that the relatively rigid support member supports the mouth of the bag in an open condition. The bag 7 may be positioned next to the spent casing ejector of the firearm 15 when the firearm 15 is held by a hand on which the apparatus 10 is mounted.

The apparatus 10 may also include an attachment structure for selectively attaching the base member 11 to the hand-engaging member 1. The attachment structure may have a first portion 2 mounted on the hand-engaging member and a second portion 12 mounted on the spent casing collection apparatus 5. These two portions removably attach to each other so that the base member 11 can be separated from the hand-engaging member 1. The first portion 2 of the attachment structure is positioned on the body portion 3 of the hand-engaging member 1 and the second portion 12 of the attachment structure is positioned on the base member 11 of the spent casing collection apparatus 5. In one embodiment of the invention, the attachment structure employs hook and loop fasteners, and one of the portions 2, 12 comprises the hook component of the hook-and-loop fastener, while the other one of the portions 2, 12 comprises the loop component of the hook and loop fastener. When these portions are pressed together, the portions are releasably engaged until sufficient force is applied to pull the portions apart.

When the firearm 15 is fired, the spent casing is ejected from the side of the device. Force from the ejection mechanism of the firearm propels the casing from the firearm into the mouth of the casing collection container 7. The container support member 6 keeps the bag open to accept subsequent ejected spent casings.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand-mountable apparatus for collecting spent casings ejected from a firearm, comprising:

a hand-engaging member for engaging a hand of a user attached to a spent casing collection apparatus for catching ejected casings from a firearm held by the hand of the user;

wherein the hand-engaging member comprises a body portion having a back wall for positioning adjacent to the palm of the user's hand and a front wall for positioning adjacent to the side of the hand opposite the palm, a portion of said back and front walls being secured to each other.

2. The apparatus of claim 1 wherein the hand-engaging member generally comprises a glove.

3. The apparatus of claim 1 wherein the spent casing collection apparatus comprises:

a base member for mounting on the hand-engaging member;

a container support member mounted on the base member; and a casing collection container mounted on the container support member.

4. The apparatus of claim 3 wherein the base member has a front side and a back side, a top end and a bottom end, and a pair of side edges extending between the top and bottom ends.

5. The apparatus of claim 4 wherein the base member has a first flange on a first one of the side edges and a second flange on a second one of the side edges;

wherein the flanges extend from the back side of the base member away from the hand of the user when mounted for use on the hand of the user.

6. The apparatus of claim 5 wherein the base member includes a shaft extending between the flanges and being secured to the flanges.

7. The apparatus of claim 3 wherein the container support member is pivotally mounted on the base member.

8. The apparatus of claim 7 wherein the container support member has a pair of apertures, the apertures of the container support member each receiving a portion of the base member to attach the container support member to the base member.

9. The apparatus of claim 8 wherein the container support member includes a locking means for locking the support member in a position relative to the base member.

10. The apparatus of claim 9 wherein the locking means comprises a first opening in the base member and a second opening in the support member, and a securing pin removably positionable in the first and second openings.

11. The apparatus of claim 3 wherein the casing collection container comprises a container with at least one opening;

wherein the container engages the support member in a manner such that the support member maintains the opening in an open condition.

12. The apparatus of claim 11 wherein the container comprises a bag.

13. The apparatus of claim 1 additionally comprising attachment means for removably attaching the spent casing collection apparatus to the hand-engaging member.

14. The apparatus of claim 13 wherein the attachment means comprises a first portion mounted on the hand engaging member and a second portion mounted on the spent casing collection apparatus; and wherein the first and second portions of the attachment means being removably securable together so that the base member can be separated from the hand-engaging member.

15. The apparatus of claim 1 wherein the hand-engaging member generally comprises a glove;

wherein the spent casing collection apparatus comprises:

a base member for mounting on the hand-engaging member;

a container support member mounted on the base member; and a casing collection container mounted on the container support member;

wherein the base member has a front side and a back side, a top end and a bottom end, and a pair of side edges extending between the top and bottom ends;

wherein the base member has a first flange on a first one of the side edges and a second flange on a second one of the side edges;

wherein the flanges extend from the back side of the base member away from the hand of the user when mounted for use on the hand of the user;

wherein the base member includes a shaft extending between the flanges and being secured to the flanges;

wherein the container support member is pivotally mounted on the base member;

wherein the container support member has a pair of apertures, the apertures of the container support member each receiving a portion of the base member to attach the container support member to the base member;

wherein the container support member includes a locking means for locking the support member in a position relative to the base member;

wherein the locking means comprises a first opening in the base member and a second opening in the support member, and a securing pin removably positionable in the first and second openings;

wherein the casing collection container comprises a container with at least one opening;

wherein the container engages the support member in a manner such that the support member maintains the opening in an open condition;

wherein the container comprises a bag;

attachment means for removably attached the spent casing collection apparatus to the hand-engaging member, the attachment means comprising a first portion mounted on the hand engaging member and a second portion mounted on the spent casing collection apparatus, the first and second portions of the attachment means being removably securable together so that the base member can be separated from the hand-engaging member.

16. A hand-mountable apparatus for collecting spent casings ejected from a firearm, comprising:

a hand-engaging member for engaging a hand of a user attached to a spent casing collection apparatus for catching ejected casings from a firearm held by the hand of the user;

wherein the hand-engaging member generally comprises a glove.

17. The apparatus of claim 16 wherein the spent casing collection apparatus comprises:

a base member for mounting on the hand-engaging member;

a container support member mounted on the base member;

a casing collection container mounted on the container support member; and wherein the container support member is pivotally mounted on the base member.

18. A hand-mountable apparatus for collecting spent casings ejected from a firearm, comprising:

a hand-engaging member for engaging a hand of a user attached to a spent casing collection apparatus for catching ejected casings from a firearm held by the hand of the user;

wherein a position of at least a portion of the spent casing collection apparatus is pivotally adjustable with respect to the hand-engaging member to permit positioning of the collection apparatus with respect to a firearm held in the hand of the user and wherein the hand-engaging member comprises a body portion having a back wall for positioning adjacent to the palm of the user's hand and a front wall for positioning adjacent to the side of the hand opposite the palm, a portion of said back and front walls being secured to each other.

19. The apparatus of claim 18 wherein the spent casing collection apparatus comprises:

a base member for mounting on the hand-engaging member;

a container support member mounted on the base member;

a casing collection container mounted on the container support member; and wherein the container support member is pivotally mounted on the base member.

* * * * *